US008267178B1

(12) United States Patent
Sommers et al.

(10) Patent No.: US 8,267,178 B1
(45) Date of Patent: Sep. 18, 2012

(54) VALVE FOR HYDRAULIC FRACTURING THROUGH CEMENT OUTSIDE CASING

(75) Inventors: Michael T. Sommers, Broken Arrow, OK (US); Stephen L. Jackson, Richmond, TX (US)

(73) Assignee: Team Oil Tools, LP, The Woodlands, TX (US)

( * ) Notice: Subject to any disclaimer, the term of this patent is extended or adjusted under 35 U.S.C. 154(b) by 0 days.

(21) Appl. No.: 13/223,909

(22) Filed: Sep. 1, 2011

(51) Int. Cl.
*E21B 34/14* (2006.01)

(52) U.S. Cl. ..... 166/334.4; 166/373; 166/386; 166/317

(58) Field of Classification Search ..... 166/373, 166/386, 317, 332.1, 334.4
See application file for complete search history.

(56) References Cited

U.S. PATENT DOCUMENTS 2,251,977 A * 8/1941 Burt ..... 166/156
4,515,217 A * 5/1985 Stout ..... 166/297
4,609,005 A * 9/1986 Upchurch ..... 137/68.22
5,261,486 A * 11/1993 Cornette et al. ..... 166/51
6,286,594 B1 * 9/2001 French ..... 166/151
6,293,342 B1 * 9/2001 McGarian et al. ..... 166/317
6,464,008 B1 * 10/2002 Roddy et al. ..... 166/285
7,055,598 B2 * 6/2006 Ross et al. ..... 166/236
2005/0072575 A1 * 4/2005 Yeo et al. ..... 166/374
2007/0272411 A1 * 11/2007 Lopez De Cardenas et al. ..... 166/305.1
2009/0095486 A1 * 4/2009 Williamson, Jr. ..... 166/373
2010/0314562 A1 * 12/2010 Bisset ..... 251/12

* cited by examiner

*Primary Examiner* — Kenneth L Thompson

(74) *Attorney, Agent, or Firm* — Lee, Jorgensen, Pyle & Kewalramiani, PC

(57) ABSTRACT

A valve for use in fracing through cement casing in a well allows for flow of cement down the well during the cementing process and in the open position allows for fracing fluid to be directed through the cement casing for fracturing the formation adjacent the valve. The valve is constructed so as to reduce the likelihood of the valve to jam as a result of cement or other foreign material.

32 Claims, 4 Drawing Sheets

VALVE FOR HYDRAULIC FRACTURING THROUGH CEMENT OUTSIDE CASING

BACKGROUND OF INVENTION

1. Field of the Invention

This invention is directed to a valve utilized for hydraulically fracturing multiple zones in an oil and gas well without perforating the cement casing. A relatively new oil/gas well completion method involves the use of a valve that is installed as part of the casing string of the well and provides for cement flow within the casing when the valve element is in a closed position and allows for axial flow of fracturing fluid through the cement casing to fracture the formation near the valve. The invention disclosed herein is an improved valve used in this process.

2. Description of Related Art

Current designs for valves used in the completion method disclosed above are prone to failure because cement or other debris interferes with the opening of the valve after the cementing process has been completed. Portions of the sliding sleeve or pistons commonly used are exposed to either the flow of cement or the cement flowing between the well bore and the casing string.

BRIEF SUMMARY OF THE INVENTION

The valve according to the invention overcomes the difficulties described above by isolating a sliding sleeve between an outer housing and an inner mandrel. A rupture disk in the inner mandrel ruptures at a selected pressure. Pressure will then act against one end of the sliding sleeve and shift the sleeve to an open position so that fracturing fluid will be directed against the cement casing. The sliding sleeve includes a locking ring nut to prevent the sleeve from sliding back to a closing position.

DETAILED DESCRIPTION OF THE INVENTION

Figure 1:
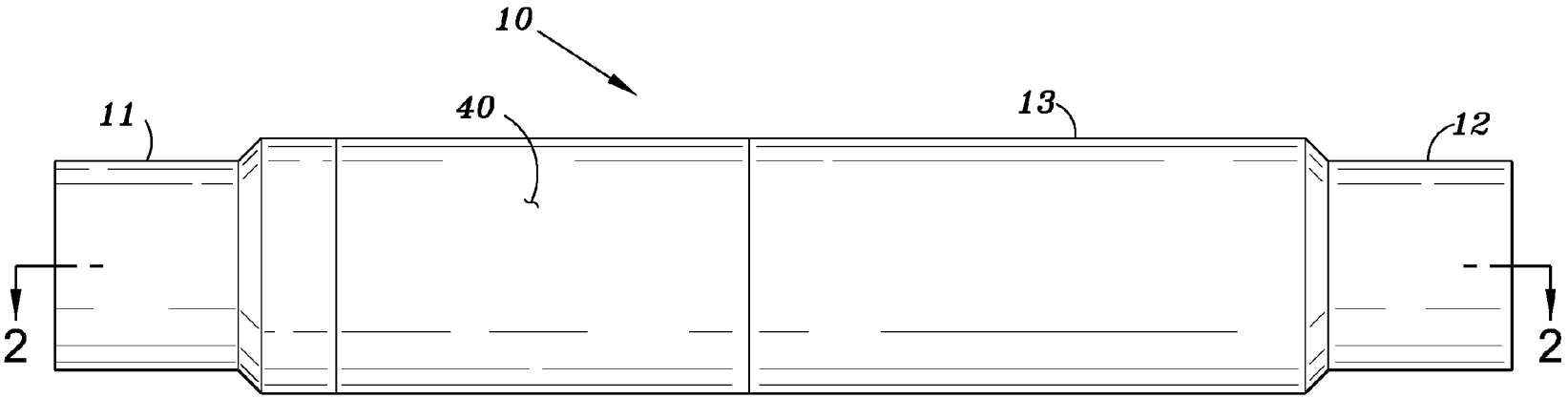
FIG. 1 is a side view of the valve according to one embodiment of the invention.

As shown in FIG. 1, an embodiment of valve 10 of the invention includes a main housing 13 and two similar end connector portions 11, 12.

Main housing 13 is a hollow cylindrical piece with threaded portions 61 at each end that receive threaded portions 18 of each end connector. End connectors 11 and 12 may be internally or externally threaded for connection to the casing string. As show in FIG. 2, main housing 13 includes one or more openings 19, which are surrounded by a circular protective cover 40. Cover 40 is made of a high impact strength material.

Figure 2:
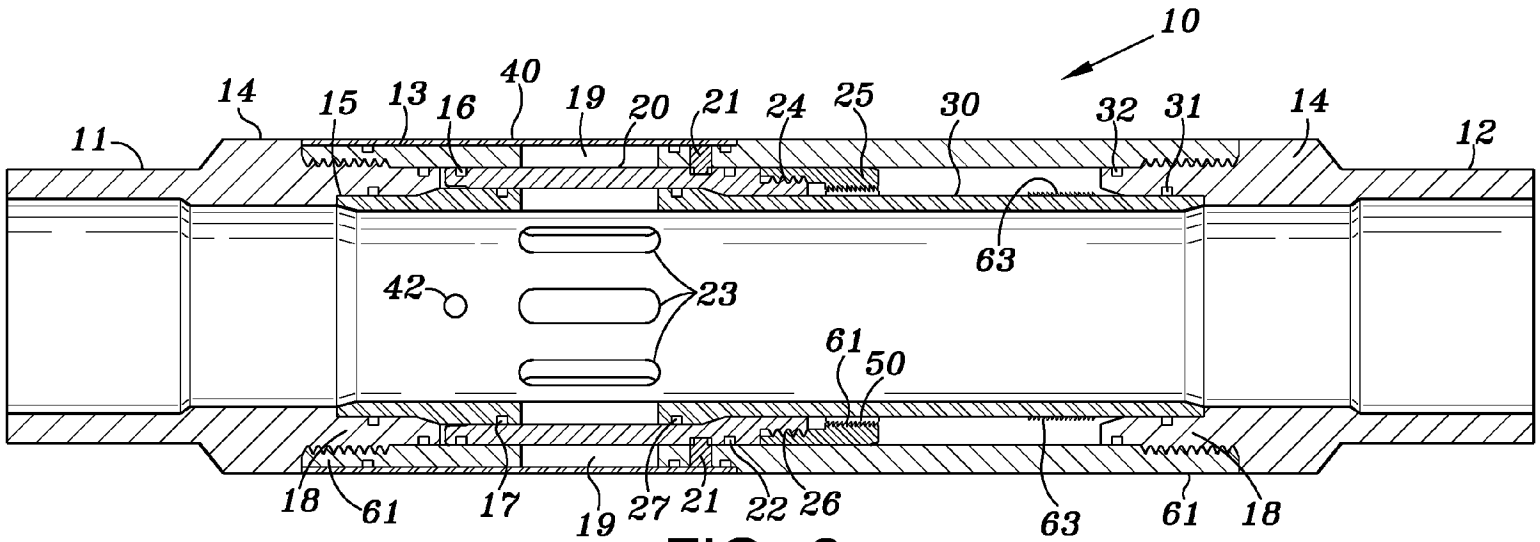
FIG. 2 is a cross sectional view of the valve in the closed position taken along line 2-2 of FIG. 1
Figure 3:
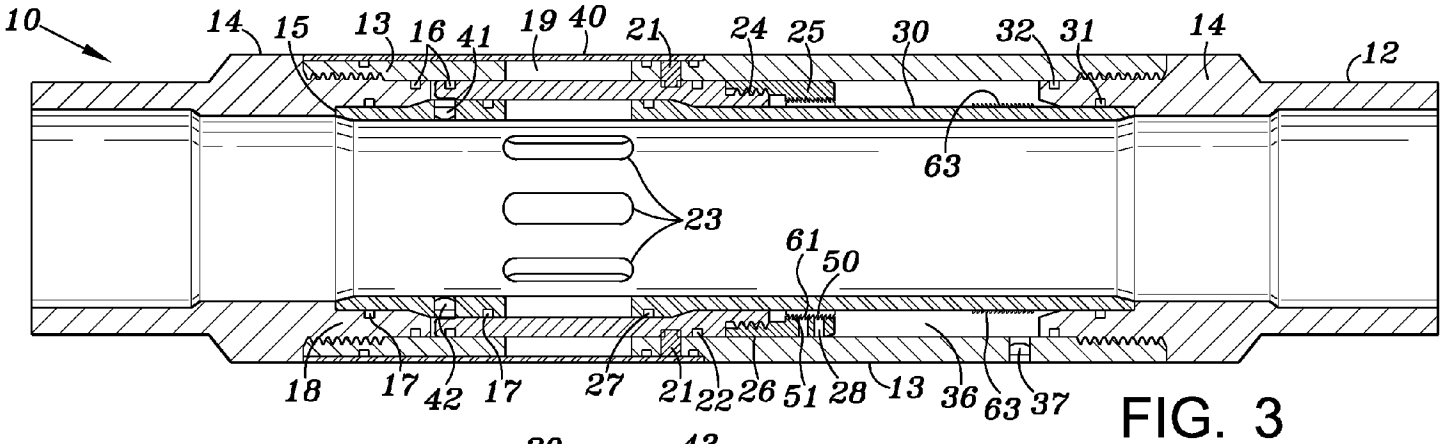
FIG. 3 is a cross sectional view of the valve taken along line 3-3 of FIG. 2

Valve 10 includes a mandrel 30 which is formed as a hollow cylindrical tube extending between end connectors 11, 12 as shown in FIG. 2. Mandrel 30 includes one or more apertures 23 that extend through the outer wall of the mandrel. Mandrel 30 also has an exterior intermediate threaded portion 51. One or more rupture disks 41, 42 are located in the mandrel as shown in FIG. 3. Rupture disks 41, 42 are located within passageways that extend between the inner and outer surfaces of the mandrel 30. Annular recesses 17 and 27 are provided in the outer surface of the mandrel for receiving suitable seals.

Figure 4:
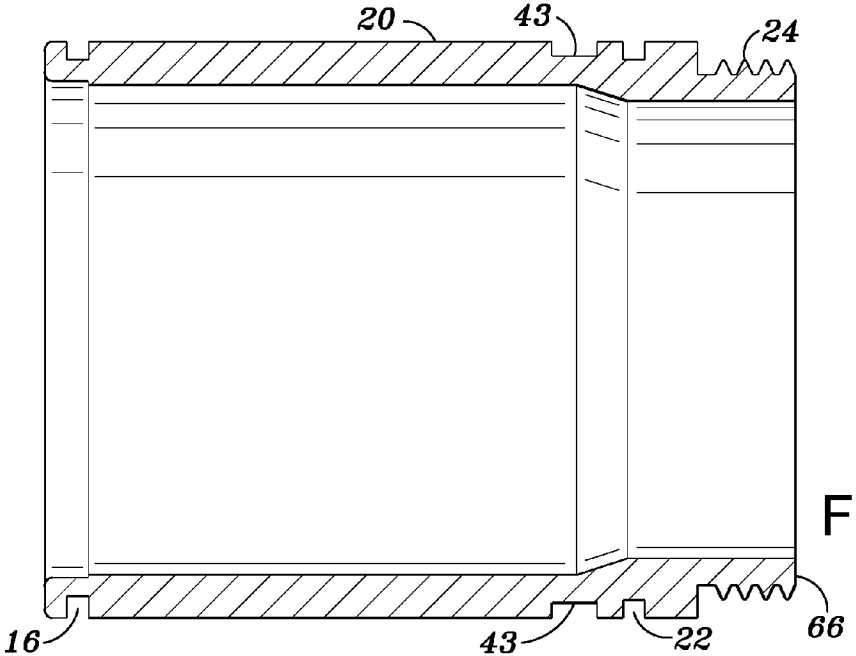
FIG. 4 is a cross sectional view of the sliding sleeve
Figure 5:
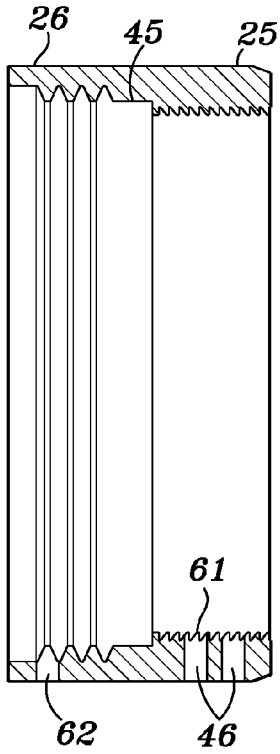
FIG. 5 is a cross sectional view of the locking ring holder
Figure 6:
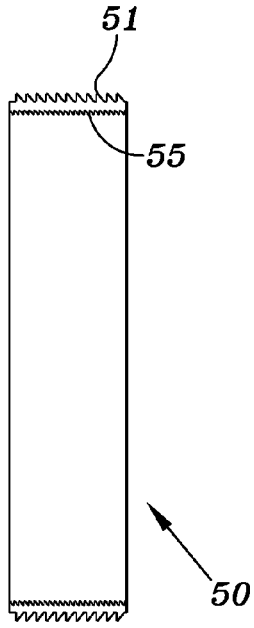
FIG. 6 is a cross sectional view of the locking ring

Mandrel 30 is confined between end connectors 11 and 12 by engaging a shoulder 15 in the interior surface of the end connectors. End connectors 11 and 12 include longitudinally extending portions 18 that space apart outer housing 13 and mandrel 30 thus forming a chamber 36. Portions 18 have an annular recess 32 for relieving a suitable seal. A sliding sleeve member 20 is located within chamber 36 and is generally of a hollow cylindrical configuration as shown in FIG. 4. The sliding sleeve member 20 includes a smaller diameter portion 24 that is threaded at 66. Also it is provided with indentations 43 that receive the end portions of shear pins 21. Sliding sleeve member 20 also includes annular grooves 16 and 22 that accommodate suitable annular seals.

Figure 7:
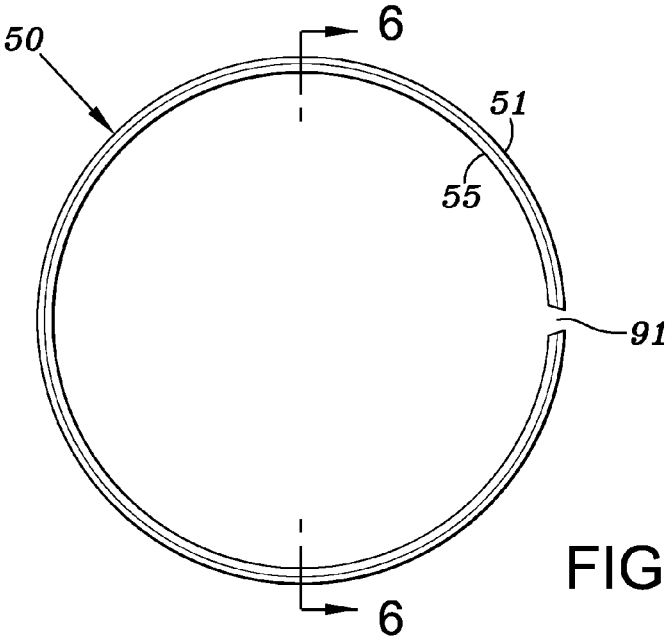
FIG. 7 is an end view of the locking ring
Figure 8:
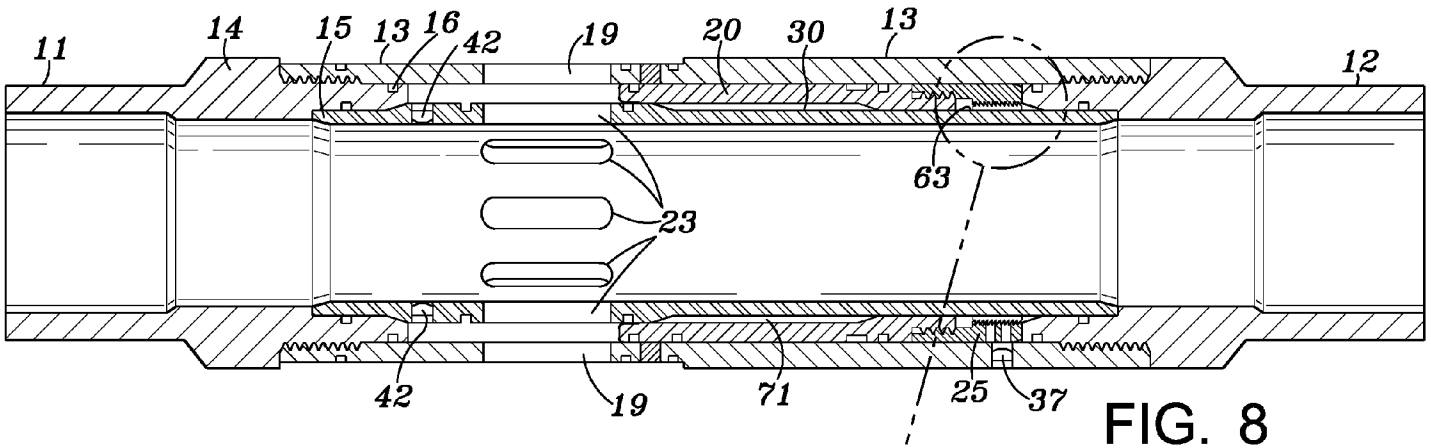
FIG. 8 is a cross sectional view of the valve in the open position
Figure 9:
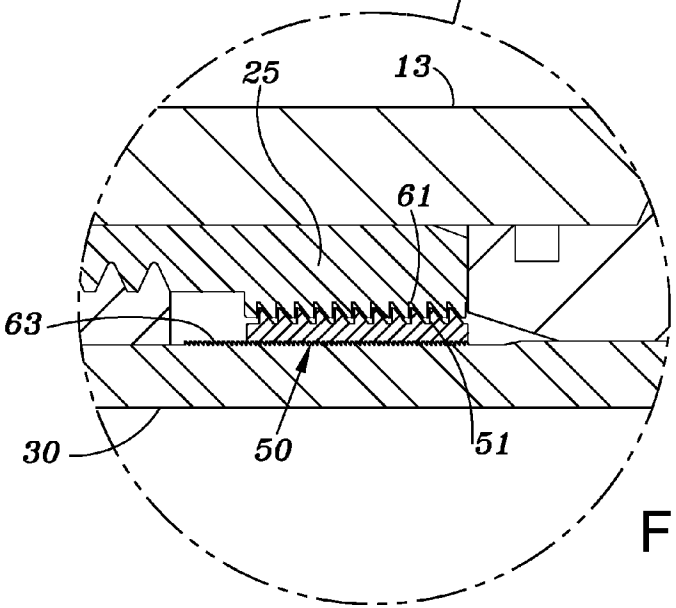
FIG. 9 is an enlarged view of the area circled in FIG. 8.

A locking ring holder 25 has ratchet teeth 61 and holds locking ring 50 which has ratchet teeth 51 on its outer surface and ratchet teeth 55 on its inner surface shown in FIG. 9. Locking ring 50 includes an opening at 91 as shown in FIG. 7 which allows it to grow in diameter as the sliding sleeve moves from the closed to open position.

Locking ring holder 25 has sufficient diameter clearance so that the locking ring can ratchet on the mandrel ratcheting teeth 63 yet never loose threaded contact with the lock ring holder. Locking ring holder 25 is threaded at 26 for engagement with threads 24 on the mandrel. Locking ring holder 25 also has a plurality of bores 46 and 62 for set screws, not shown.

In use, valve 10 may be connected to the casing string by end connectors 11, 12. One or more valves 10 may be incorporated into the casing string. After the casing string is deployed within the well, cement is pumped down through the casing and out the bottom into the annulus between the well bore and the casing as typical in the art. After the cement flow is terminated, a plug or other device is pumped down to wipe the casing and valve clean of residual cement. When the plug or other device has latched or sealed in the bottom hole assembly, pressure is increased to rupture the rupture disk at a predetermined pressure. The fluid pressure will act on sliding sleeve member 20 to cause the shear pins to break and then to move it downward or to the right as shown in FIG. 7. This movement will allow fracing fluid to exit via opening 23 in the mandrel and openings 19 in the outer housing. The fracing fluid under pressure will remove protective cover 40 and crack the cement casing and also fracture the foundation adjacent to the valve 10.

Due to the fact that the sliding sleeve member 20 is mostly isolated from the cement flow, the sleeve will have a lessor tendency to jam or require more pressure for actuation.

In the open position, locking ring 50 engages threads 63 on the mandrel to prevent the sleeve from moving back to the closed position.

A vent 37 is located in the outer housing 13 to allow air to exit when the valve is being assembled. The vent 37 is closed by a suitable plug after assembly.

Although the present invention has been described with respect to specific details, it is not intended that such details should be regarded as limitations on the scope of the invention, except to the extent that they are included in the accompanying claims.

We claim:

1. A valve comprising:

a housing having one or more openings, a mandrel having one or more openings positioned within the housing, a sliding sleeve disposed between the housing and the mandrel and blocking fluid communication between the openings in the housing and the openings in the mandrel when the valve is in the closed position and permitting fluid flow between the openings in the mandrel and the openings in the housing when the valve is in the open position; and one or more rupture disks disposed in a wall of the mandrel.

2. A valve according to claim 1 wherein the housing, the mandrel, and the sleeve are tubular members.

3. A valve as claimed in claim 1 further comprising a locking ring holder attached to the sliding sleeve and a locking ring positioned within the locking ring holder.

4. A valve as claimed in claim 3 further including a ratcheting teeth on the outer surface of the mandrel adapted to engage with ratcheting teeth on the locking ring.

5. A valve as claimed in claim 1 including an end connector on each end of the housing for connection in a casing string in an oil or gas well.

6. A valve as claimed in claim 1 further including a protective sleeve covering the openings in the housing.

7. A valve as claimed in claim 1, further comprising a chamber between the housing and the mandrel.

8. A valve as claimed in claim 7, wherein the sliding sleeve is disposed within the chamber.

9. A valve as claimed in claim 1, wherein a first chamber is located between the mandrel and the housing axially above the openings of the mandrel and the housing.

10. A valve as claimed in claim 9, wherein a second chamber is located between the mandrel and the housing axially below the openings of the mandrel and the housing.

11. A valve as claimed in claim 1, wherein the rupture disks are located axially above the sliding sleeve.

12. A method for actuating a valve, the method comprising:

flowing a fluid through the valve, the valve comprising;

a housing having one or more openings;

a mandrel having one or more openings, a passageway, and a rupture disk disposed in the passageway; and a sliding sleeve disposed between the housing and the mandrel;

rupturing the rupture disk at a selected fluid pressure;

flowing fluid through the passageway to the sliding sleeve;

moving the sliding sleeve axially downward within the valve; exiting fluid through the one or more openings of the housing and mandrel; and cracking a cement casing with the fluid.

13. The method of claim 12, further comprising pumping cement through the valve into a wellbore.

14. The method of claim 13, further comprising wiping the valve with a plug.

15. The method of claim 12, further comprising engaging permanently the sliding sleeve with the mandrel.

16. The method of claim 12, wherein the sliding sleeve is isolated between the housing and the mandrel.

17. A valve comprising:

a housing having an opening;

a mandrel disposed in the housing, the mandrel having an opening;

a rupture disk disposed in a passageway of the mandrel, wherein the passageway is axially above the housing and mandrel openings; and a sliding sleeve disposed in a chamber formed between the housing and the mandrel.

18. The valve of claim 16, wherein the sliding sleeve is isolated from fluid flow through the valve when the valve is in a closed position.

19. A valve comprising:

a housing having one or more openings;

a mandrel having one or more openings disposed within the housing;

a rupture disk disposed in a passageway of the mandrel, wherein the passageway is axially above the one or more housing and mandrel openings;

a chamber between the housing and the mandrel; and a sliding sleeve disposed within the chamber, wherein in a closed position the sliding sleeve is isolated from fluid flow through the valve and wherein in an open position fluid flow contacts the sliding sleeve and flows through the one or more openings in the housing and the mandrel.

20. The valve of claim 19, wherein the rupture disk is configured to rupture at a selected fluid pressure, and wherein the selected fluid pressure moves the sliding sleeve within the chamber.

21. A valve comprising:

a housing having one or more openings, a mandrel having one or more openings positioned within the housing, a sliding sleeve disposed between the housing and the mandrel and blocking fluid communication between the openings in the housing and the openings in the mandrel when the valve is in the closed position and permitting fluid flow between the openings in the mandrel and the openings in the housing when the valve is in the open position;

a locking ring holder attached to the sliding sleeve;

a locking ring positioned within the locking ring holder; and a set of ratcheting teeth on the outer surface of the mandrel adapted to engage with ratcheting teeth on the locking ring.

22. A valve as claimed in claim 21 further including a protective sleeve covering the openings in the housing.

23. A valve as claimed in claim 21, further comprising a chamber between the housing and the mandrel.

24. A valve as claimed in claim 23, wherein the sliding sleeve is disposed within the chamber.

25. A valve as claimed in claim 23, wherein the first chamber is located axially above the openings of the mandrel and the housing.

26. A valve as claimed in claim 25, wherein a second chamber is located between the mandrel and the housing axially below the openings of the mandrel and the housing.

27. A method for actuating a valve, the method comprising:

flowing a fluid through the valve, the valve comprising;

a housing having one or more openings;

a mandrel having one or more openings, a passageway, and a rupture disk disposed in the passageway; and a sliding sleeve disposed between the housing and the mandrel:

rupturing the rupture disk at a selected fluid pressure;

flowing fluid through the passageway to the sliding sleeve;

moving the sliding sleeve axially downward within the valve; and exiting fluid through the one or more openings of the housing and mandrel; and pumping cement through the valve into a wellbore.

28. The method of claim 27, further comprising wiping the valve with a plug.

29. The method of claim 27, further comprising engaging permanently the sliding sleeve with the mandrel.

30. The method of claim 27, wherein the sliding sleeve is isolated between the housing and the mandrel.

31. A method for actuating a valve, the method comprising:

flowing a fluid through the valve, the valve comprising;

a housing having one or more openings;

a mandrel having one or more openings, a passageway, and a rupture disk disposed in the passageway; and a sliding sleeve disposed between the housing and the mandrel:

rupturing the rupture disk at a selected fluid pressure;

flowing fluid through the passageway to the sliding sleeve;

moving the sliding sleeve axially downward within the valve;

exiting fluid through the one or more openings of the housing and mandrel; and engaging permanently the sliding sleeve with the mandrel.

32. The method of claim 31, wherein the sliding sleeve is isolated between the housing and the mandrel.

* * * * *